US006383051B1

(12) United States Patent
Crossman et al.

(10) Patent No.: US 6,383,051 B1
(45) Date of Patent: May 7, 2002

(54) SYSTEM AND METHOD FOR DISPLAYING MAGNETIC DEVICES

(76) Inventors: Richard B. Crossman, 305 W. Oak St., Stockton, CA (US) 95203; Tamaryn K. Crossman, 305 Oak St., Stockton, CA (US) 95203

( * ) Notice: Subject to any disclaimer, the term of this patent is extended or adjusted under 35 U.S.C. 154(b) by 0 days.

(21) Appl. No.: 09/411,621

(22) Filed: Oct. 1, 1999

(51) Int. Cl.[7] ..... A63H 33/26
(52) U.S. Cl. ..... 446/83; 446/135
(58) Field of Search ..... 446/82, 83, 129, 446/132, 134, 135

(56) References Cited

U.S. PATENT DOCUMENTS

| | | | | |
|---|---|---|---|---|
| 1,123,066 | A | 12/1914 | Barber | |
| 1,332,253 | A | 3/1920 | Holloway | |
| 1,665,747 | A | 4/1928 | Loederer | |
| 1,917,977 | A | 7/1933 | Kalert et al. | |
| 2,036,076 | A | 3/1936 | Philippi | 446/135 |
| 2,086,728 | A | 7/1937 | Morrow | 446/82 |
| 2,149,779 | A | 3/1939 | Kroner | 40/615 |
| 2,784,523 | A | 3/1957 | Briggs | 446/82 |
| 3,224,127 | A | 12/1965 | Hutterer | 40/518 |
| 3,462,873 | A | 8/1969 | Moreci | 446/135 |
| 3,672,674 | A | 6/1972 | Reed | 273/317.5 |
| 3,771,256 | A | 11/1973 | Huebert | 446/137 |
| 4,041,626 | A | 8/1977 | Ellis et al. | 40/518 |
| 4,800,662 | A | 1/1989 | Belrose | 40/426 |

*Primary Examiner*—John A. Ricci
(74) *Attorney, Agent, or Firm*—Henneman & Saunders; Larry E. Henneman, Jr.

(57) ABSTRACT

A magnetic display system is disclosed, including a first screen having a front surface for contacting a magnetic display device and a second screen having a rear surface for contacting a magnetic device controller. The first screen and the second screen define therebetween a scenery receiving space for receiving at least one scenery sheet. The scenery sheet may be advanced and/or replaced while magnetic display devices are displayed on the system, without having to hold the displayed devices in place.

30 Claims, 12 Drawing Sheets

900

1900

SYSTEM AND METHOD FOR DISPLAYING MAGNETIC DEVICES

BACKGROUND OF THE INVENTION

1. Field of the Invention

This invention relates generally to displays and controllers for presenting magnetic devices, and more particularly to display screens and controllers for magnetic puppets.

2. Description of the Background Art

Magnetic displays in general, and magnetic puppets in particular, are well known. For example, U.S. Pat. No. 3,462,873, issued to Joseph G. Moreci on Aug. 26, 1969, discloses a toy, wherein character figures including a steel strip are held on to and moved about the front surface of a scenery screen by means of magnetic coupling with a controller magnet positioned on the opposite side of the screen. One disadvantage of this toy, however, is that user must remove the character figures in order to change the scenery screen.

Scrolled scenery screens are known, wherein a continuous scenery screen is advanced by rollers or the like. While such scenery screens may facilitate advancement without removing the characters, it would still be necessary for the user to hold the characters in place so that they are not moved with the advancing scenery. Additionally, the advancement of the scenery screen generally requires some action on the part of the user, for example turning a crank handle or a knob. Because the user must hold the characters in place at the same time he advances the scenery, the number of characters that can remain on the screen during scenery advancement is effectively limited.

What is needed, therefore, is a system for displaying magnetic devices that facilitates scenery changes without requiring the magnetic devices to be held in place by the user. What is also needed is a quick and simple mechanism for a user to change the scenery.

SUMMARY

The present invention overcomes the problems associated with the prior art by providing a magnetic device display system with two screens fixed relative to one another so as to define a scenery receiving space therebetween. One of the screens prevents frictional contact between magnetic devices and a scenery sheet disposed in the scenery receiving space. The other screen prevents frictional contact between the magnetic device controllers and the scenery sheet. Thus, the invention facilitates movement of the scenery sheet without requiring the user to hold the magnetic device controllers in place.

In a particular embodiment, the scenery sheet is a continuous sheet, having a first end attached to a first spool, and a second end attached to a second spool. As the scenery sheet is wound onto one of the spools or the other, the scenery sheet is drawn through the scenery receiving space. A more particular embodiment includes a drive mechanism for the scenery sheet. The drive mechanism includes a drive wheel rigidly fixed to a first end of the first spool, a freely rotatable wheel mounted to a second end of the first spool, a freely rotatable wheel mounted to a first end of the second spool, and a drive wheel rigidly fixed to a second end of the second spool. A first drive belt engages the drive wheel of the first spool and the freely rotatable wheel of the second spool. A second drive belt engages the freely rotatable wheel of the first spool and the drive wheel of the second spool. The scenery sheet wraps around the first spool in one direction, and wraps around the second spool in the opposite direction. Optionally, the drive belts include engaging structures (e.g., dimples, apertures, etc.) to facilitate advancement by a user and/or engagement of the drive wheels.

Optionally, the first screen is formed integral with a first housing portion, the second screen is formed integral with a second housing portion, and the first and second spools are supported in cavities defined between the first and second housing portions. In a one embodiment, the first and second housing portions are vacuum formed from a single sheet of material (e.g., plastic).

In a different embodiment of the present invention, the first screen is formed integral with a first peripheral portion and the second screen is formed integral with a second peripheral portion. The first peripheral portion includes at least one fastener, and the second peripheral portion includes at least one complementary fastener. The first screen is fixed relative to the second screen by engaging the fastener with the complementary fastener. In a particular embodiment, the fasteners are vacuum formed dimples. In another particular embodiment, alignment guides are integrally formed in either the first peripheral portion, or the second peripheral portion, or both, to facilitate insertion of scenery media into the scenery receiving space.

An even more particular embodiment includes an optional window sheet that is fixed with respect the first screen, and through which the first screen is viewed. Optionally, the first screen, the first peripheral portion, the second screen, the second peripheral portion, and the window sheet are all formed from a single sheet of material. The window sheet is optionally disposed between the first peripheral portion and the second peripheral portion in the single sheet of material, but is disposed in front of said first screen when the single sheet of material is folded to form a display system.

Various novel magnetic display devices are also disclosed.

BRIEF DESCRIPTION OF THE DRAWINGS

The present invention is described with reference to the following drawings, wherein like reference numbers denote substantially similar elements.

DETAILED DESCRIPTION

The present invention overcomes the problems associated with the prior art, by providing a magnetic display system with two screens which facilitates moving scenery sheets between the screens while magnetic devices and controllers are magnetically coupled to each other through the screens. In the following description, numerous specific details are set forth (e.g., particular types of scenery sheets and magnetic devices) in order to provide a thorough understanding of the invention. Those skilled in the art will recognize, however, that the invention may be practiced apart from these or other specific details. In other instances, details of well known manufacturing practices (e.g., particular vacuum forming procedures) and components (e.g., magnetic properties) have been omitted, so as not to unnecessarily obscure the present invention.

Figure 1:
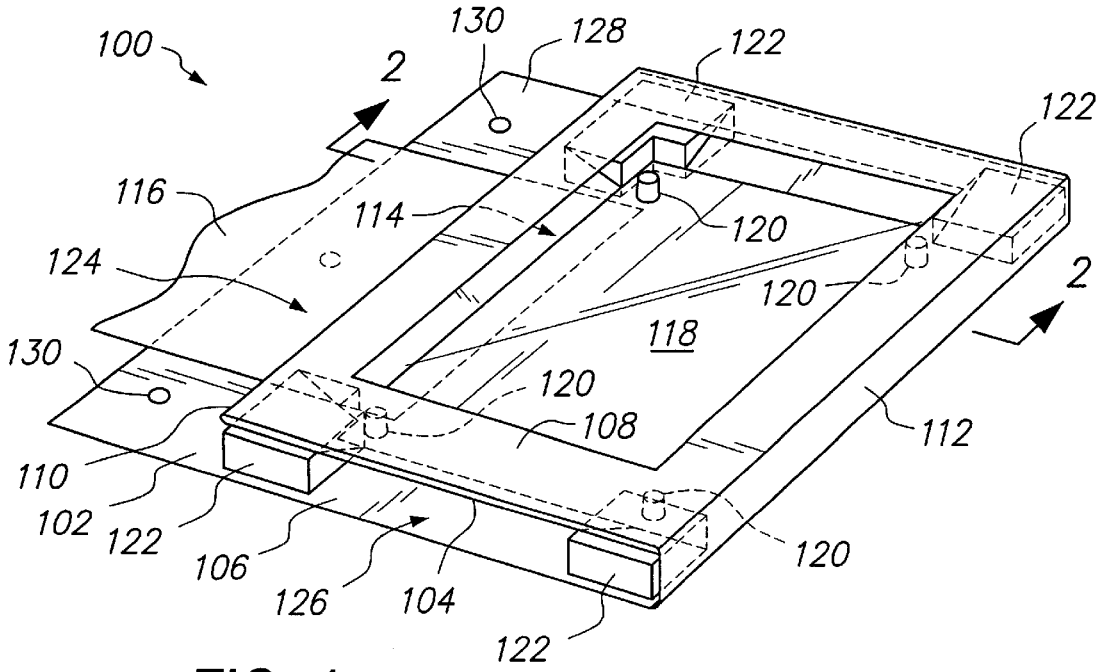
FIG. 1 is a perspective view of a magnetic display system according to the present invention.

FIG. 1 is a perspective view of a display system 100 for magnetic devices (e.g., magnetic puppets) formed from a single sheet 102 of material (e.g., vacuum-formed plastic). Sheet 102 includes a first screen section 104, a second screen section 106, a window sheet portion 108, a first end portion 110, and a second end portion 112. First end portion 110 and second end portion 112 facilitate folding sheet 102 such that first screen 104 overlies and is substantially parallel to second screen 106, and such that window sheet 108 overlies and is substantially parallel to first screen 104. Thus disposed, first screen 104 and second screen 106 define therebetween a scenery receiving space 114 for receiving one or more scenery sheets 116 (e.g., background scenery for a magnetic puppet show). Scenery sheets 116, when disposed in scenery receiving space 114, are visible to an audience through a window 118. Window 118 can optionally be formed as a transparent or translucent portion, for example an aperture, in window sheet portion 108.

Display system 100 further includes a plurality of fasteners 120 and a plurality of alignment guides 122. Fasteners 120 fix first screen 104 and second screen 106 together. Alignment guides 122 facilitate easy insertion and alignment of scenery sheets in scenery receiving space 114, through either a top opening 124 or a side opening 126. An optional tab portion 128 of sheet 102 includes a plurality of holes 130 for securing display system 100 in a three-ring binder or the like.

Figure 2:
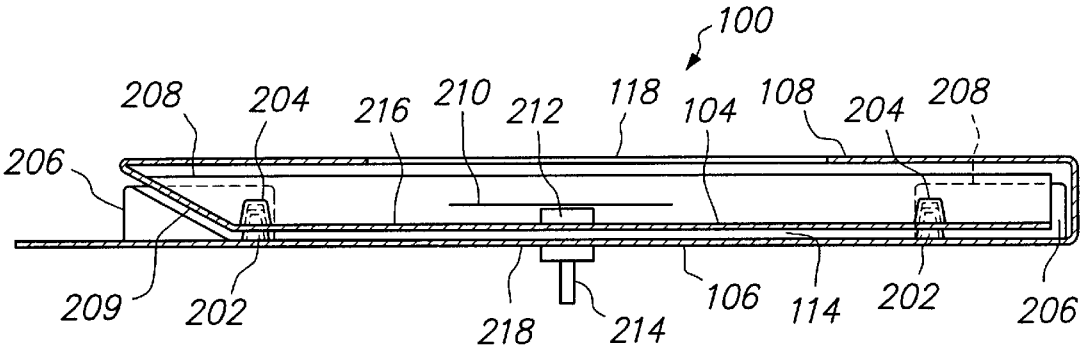
FIG. 2 is a cross-sectional view of the magnetic display system of FIG. 1 taken along line 2—2.

FIG. 2 is a cross-sectional view of display system 100 taken along line 2—2 of FIG. 1. As shown in FIG. 2, each of fasteners 120 actually include a fastener 202 formed in second screen section 106 and a complementary fastener 204 formed in first screen section 104. In this particular embodiment fasteners 202 and complementary fasteners 204 are vacuum formed dimples, but those skilled in the art will recognize that alternate fasteners (e.g., hook-loop, adhesive, thermal weld, etc.) may be employed to fix first screen section 104 and second screen section 106 to one another.

Alignment guides 122 each include a raised portion 206 formed in second screen section 106 and a complementary receiving portion 208 formed in first screen section 104. When first screen portion 104 is fastened to second screen portion 106, raised portions 206 fit into receiving portions 208, providing additional stability to display system 100, in addition to facilitating the insertion and alignment of scenery sheets as described above.

FIG. 2 also shows a magnetic puppet 210 and a magnetic follower 212 magnetically coupled to a controller 214, through first screen 104 and second screen 106. Magnetic puppet 210 includes a magnetic strip (not shown) which is attracted to a magnet (not shown) in follower 212, thus holding puppet 210 to the top face of follower 212. Controller 214 also includes a magnet (not shown). When follower 212 and controller 214 magnetically couple through first screen 104 and second screen 106, the bottom face of follower 212 contacts a front surface of first screen 104, and the top surface of controller 214 contacts a rear surface 218 of second screen 106. Thus coupled, puppet 210 and follower 212 can be moved about front surface 216 of first screen 104 by moving controller 214 on back surface 218 of second screen 106.

First screen 104 and second screen 106 prevent frictional contact between scenery sheets 116 (omitted from FIG. 2 for clarity) and follower 212, and between scenery sheets 116 and controller 214, respectively, thus overcoming the problems associated with the prior art. Because there is no frictional contact between scenery sheets 116 and follower 212 or controller 214, scenery sheets 116 can be inserted and/or removed without holding controller 214 in place. For example, scenery sheets 116 may include a plurality of sheets depicting sequential scenes in a puppet show. The puppeteer would simply pull the front most scenery sheet out of scenery receiving space to advance to the next scene. Because controller 214 need not be held in place, the puppeteer's hands will be free to accomplish the scenery change.

Sliding friction between follower 212 and first screen 104, and between controller 214 and second screen 106 can be reduced by texturing the contact surfaces of screens 104 and/or 106. Scenery sheet 116 will still be visible even though first screen 104 is textured, because of the close proximity between first screen 104 and scenery sheet 116.

Figure 3:
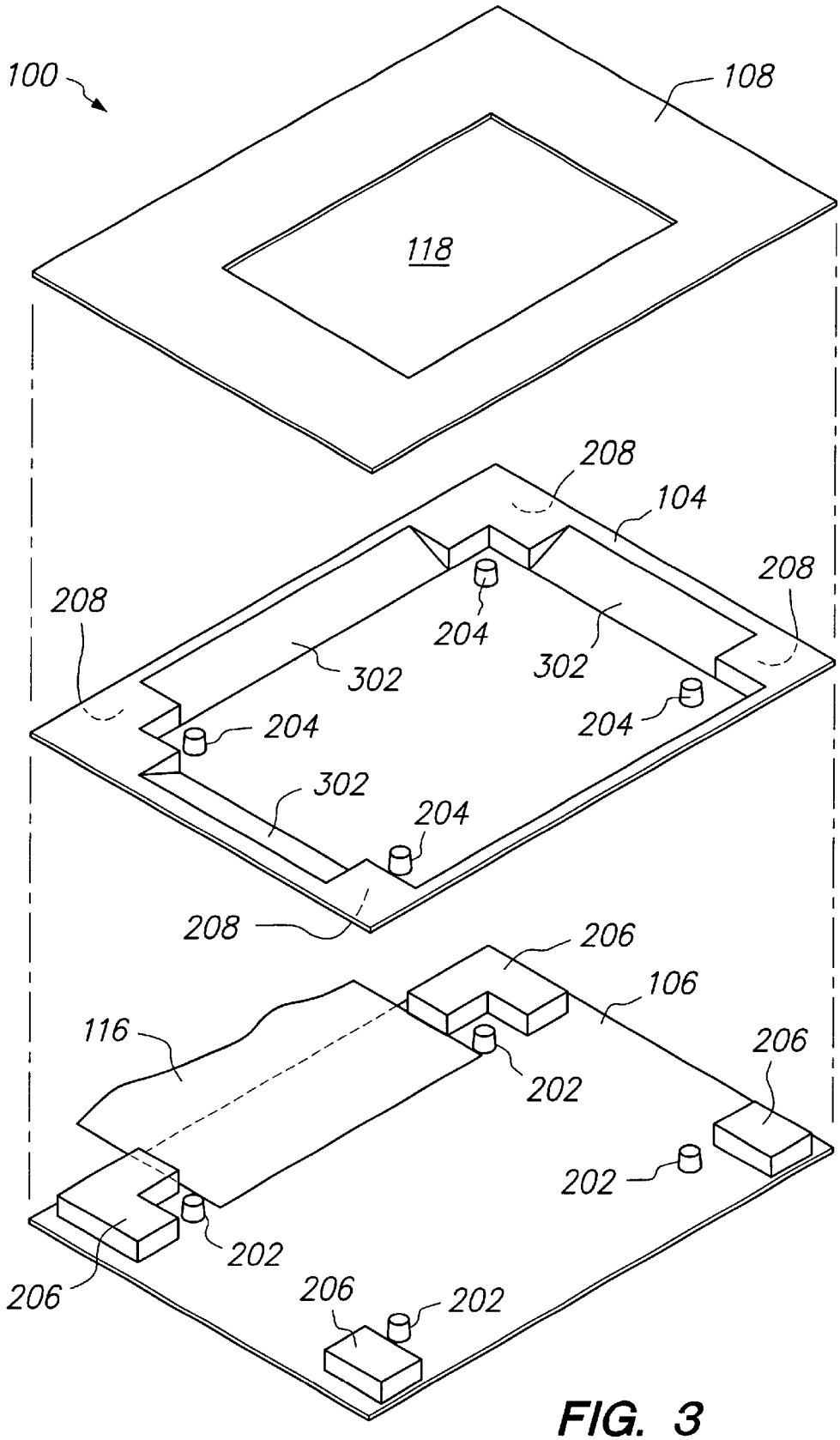
FIG. 3 is a fragmented, exploded view of the magnetic display system of FIG. 1.

FIG. 3 is a fragmented, exploded view of display system 100. A plurality of ramp portions 302 are formed in first screen section 104, and function to guide the inserted scenery sheets 116 into scenery receiving space 114, below first screen section 104 and above second screen section 106. While FIG. 3 is provided to more clearly show the details of display system 100, it should also make apparent to those skilled in the art that display system 100 may optionally be constructed from separate sheets, as opposed to single sheet 102.

Figure 4:
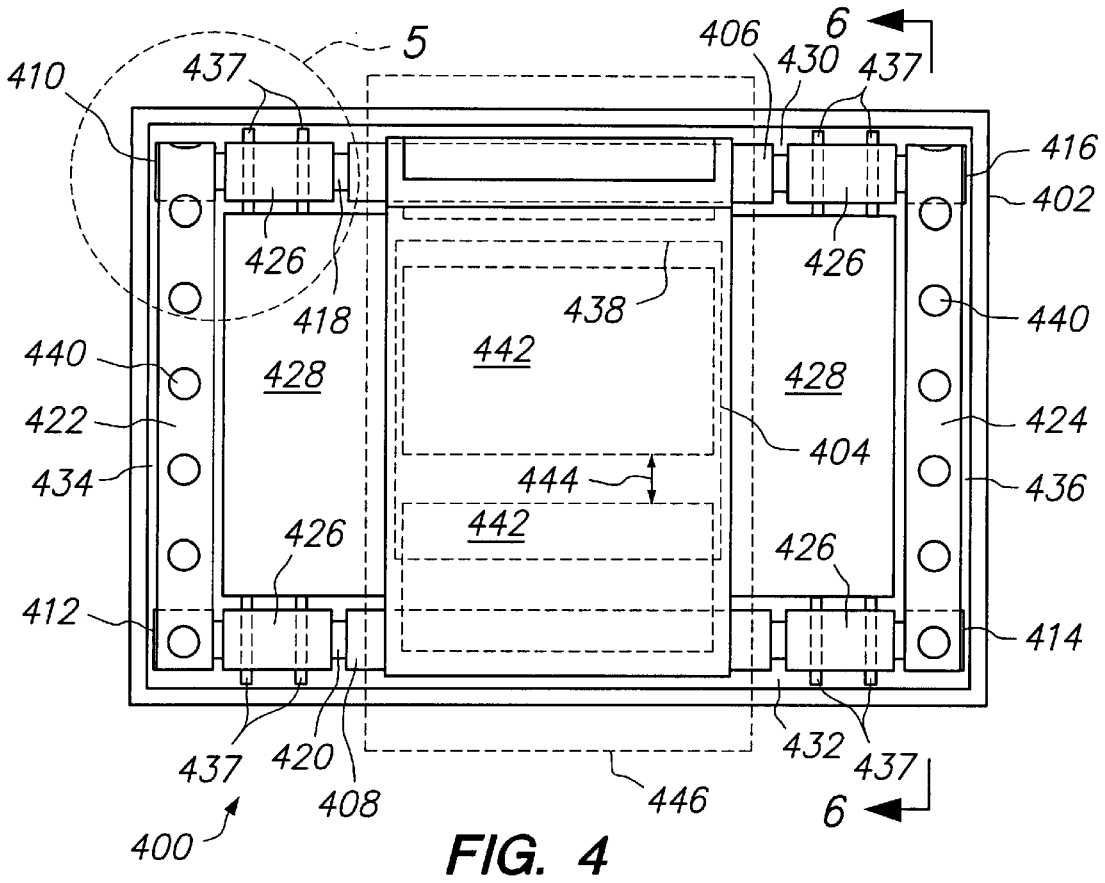
FIG. 4 is a rear plan view of an alternate magnetic display system according to the present invention.

FIG. 4 is a rear view of an alternate display system 400, with a novel scenery sheet driving mechanism. Display system 400 includes a front housing 402, a continuous scenery sheet 404, a first spool 406, a second spool 408, a first drive-wheel 410, a first free-wheel 412, a second drive-wheel 414, a second free-wheel 416, a first axle 418, a second axle 420, a first drive belt 422, a second drive belt 424, and a plurality of bearing blocks 426. Display system 400 further includes a rear housing (not shown in FIG. 4) which is similar to front housing 402, and which, together with front housing 402 houses the remaining components of display system 400.

Front housing 402 includes a front screen portion 428, a first spool channel 430, a second spool channel 432, a first drive channel 434, a second drive channel 436, and a plurality of support dimples 437, all integrally formed in front housing 402. Front screen portion 428 is screen upon which magnetic puppets are displayed, and through which scenery sheet 404 is viewed by an audience. Optionally, a portion 438 of front screen 428 is detachable to provide access to scenery sheet 404 after display system 400 is assembled, to allow for example, a child to color scenery sheet 404.

Figure 5:
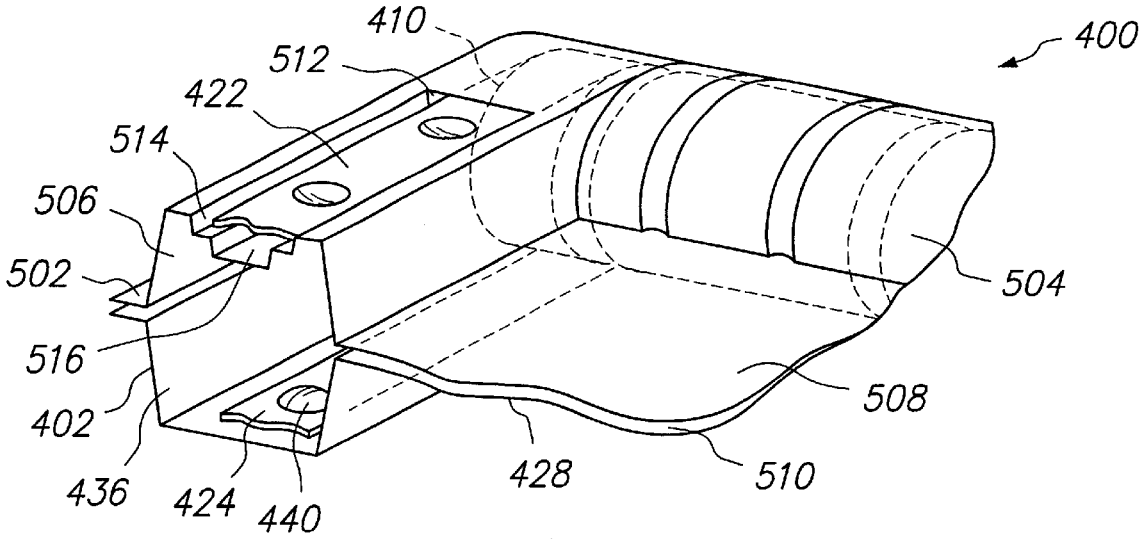
FIG. 5 is a partially cut-away view showing a portion of the magnetic display system of FIG. 4, identified therein as portion 5.

First spool 406, first drive-wheel 410, and second free-wheel 416 are mounted on first axle 418, which is supported in first spool channel 430 by support dimples 437 and a pair of bearing blocks 426. Second spool 408, second drive-wheel 414, and first free-wheel 412 are mounted on second axle 420, which is supported in second spool channel 432 by another pair of bearing blocks 426. Optionally, bearing blocks 426 are formed integrally with front housing 402 and/or rear housing 502 (FIG. 5). First drive-wheel 410 and second drive-wheel 414 are rigidly fixed to first axle 418 and second axle 420, respectively. In contrast, first free-wheel 412 and second free-wheel 416 are freely rotatable about second axle 420 and first axle 418, respectively. First drive belt 422 engages first drive-wheel 410 and first free-wheel 412, and second drive belt 424 engages second drive-wheel 414 and second free-wheel 416. In this particular embodiment, each of drive belts 422 and 424 include a plurality of dimples 440 which engage wheels 410, 412, 414, and 416, and which may be engaged by a user's finger.

Scenery sheet 404 is attached to both first spool 406 and second spool 408. Scenery sheet 404 wraps around first spool 406 in one direction, passing in front of and then over first spool 406. Scenery sheet 404 wraps around second spool 408 in an opposite direction, passing behind and then under second spool 408.

Scenery sheet 404 is drawn either upward or downward as follows. When a user engages first drive-belt 422 and draws it downward, belt 422 rotates drive-wheel 410 and attached axle 418 and spool 406 in the direction to wind scenery sheet 404 upward onto spool 406. Free-wheel 412 allows axle 420 and spool 408 to rotate in an opposite direction to allow scenery sheet 404 to unwind from spool. As scenery sheet 404 unwinds from spool 408, drive-wheel 414 and belt 424 rotate with spool 408. Free-wheel 416 facilitates the rotation of axle 418 and spool 406 in a direction opposite that of spool 408 and axle 420.

When a user draws belt 424 in a downward direction, drive wheel 414 rotates spool 408 in a direction to wind scenery sheet 404 downward onto spool 408, and drawing scenery sheet 404 off of spool 406. As described above, free-wheels 412 and 416 facilitate the rotation of spools 406 and 408 in opposite directions.

In summary, when a user draws belt 422 in a downward direction, scenery sheet 404 advances in an upward direction. When a user draws belt 424 in a downward direction, scenery sheet 404 advances in a downward direction. Being able to advance scenery sheet 404 in either direction with a downward stroke of a user's finger is beneficial, because in both cases the user is pushing down toward a supporting structure (e.g., a table top upon which display system 400 is resting). In contrast, if the user were required to draw upward on one of belts 422 or 424, the upward force would tend to lift display system 400 up off of the supporting structure.

It is possible to construct an alternate display system, similar to display system 400, but requiring only one drive belt. In the single belt system, free-wheel 416 and drive-wheel 414 are replaced with wheels that selectively engage axles 418 and 420, respectively. In a first operating mode, axle 418 is engaged and axle 420 is disengaged, and a downward draw on belt 424 will, therefore, wind scenery sheet 404 upward onto spool 406. In a second operating mode, axle 420 is engaged and axle 418 is disengaged, and a downward draw on belt 424 will, therefore, wind scenery sheet 404 downward onto spool 408. Thus, scenery sheet 404 can be advanced in either direction by a draw on belt 424, and belt 422 is unnecessary and can be omitted.

As more and more of scenery sheet 404 is drawn onto spool 406, the diameter of spool 406 including the wound scenery sheet 404 increases, resulting in an increased linear transition of scenery sheet 404 with each complete draw of belt 422. Because it is desirable to advance scenery sheet 404 by exactly one scenery frame 442 with each full draw of belt 422, the space 444 between adjacent scenery frames 442 is incrementally increased as more of scenery sheet 404 is wound onto spool 406. Thus, the space 444 between adjacent scenery frames 442 at the beginning of scenery sheet 404 is smaller than the space 444 between adjacent scenery frames 442 at the end of scenery sheet 404. Additionally, the diameter of spool 406 itself must be sufficient to advance scenery sheet 404 by at least one frame, because initially there is little if any of scenery sheet 404 wound around spool 406.

Various components of display system 400 can be embodied in one or more detachable sub-systems. For example, box 446 indicates representationally that spools 406 and 408, scenery sheet 404, a portion of front screen 428, and a portion of a rear screen (not shown) may be manufactured as a detachable cassette, and the remaining components can be included in a drive section. Including scenery sheet 404 and spools 406 and 408 in a detachable cassette facilitates the use of several scenery sheets with a single drive section, and eliminates the reloading of scenery sheets on spools 406 and 408. One or more elements of the drive section can be modified to engage cassette 446. For example, spring-loaded axles can be substituted for axles 418 and 420.

FIG. 5 is a partially cut-away, perspective view of a portion of display system 400 identified as area 5 in FIG. 4. FIG. 5 shows rear housing 502 which was omitted from FIG. 4, so as not to obscure the view of the other components of display system 400. Rear housing 502 includes two spool channels and two drive channels (complementary to spool channels 430 and 432 and to drive channels 434 and 436), but only spool channel 504 and drive channel 506 are visible in FIG. 5.

In a particular embodiment, front housing 402 and rear housing 502 are vacuum formed from a single piece of material (e.g., plastic). All internal components (e.g., spools, axles, etc.) are then assembled in rear housing 502. Finally, front housing 402 is folded over rear housing 502, in clam-shell fashion, to house the assembled components in a cavity formed between front housing 402 and rear housing 502.

Rear housing 502 further includes a rear screen portion 508 that, together with front screen portion 428 of front housing 402, defines a scenery receiving space 510 therebetween. When scenery sheet 404 is wound from one of spools 406 and 408 to the other, as described above, scenery sheet 404 is drawn through scenery receiving space 510.

FIG. 5 also shows an optional feature of rear housing 502. In particular, each side of rear housing 502 includes a pair of apertures 512 (only one is visible in FIG. 5) that allow belts 422 and 424 to pass between the interior and exterior of display system 400. Each side of rear housing 502 further includes a channel 514 to guide and support belts 422 and 424 (not shown). Those skilled in the art will recognize that channel 514 may be adapted to accommodate any unique features of any alternate drive belts which may be employed. For example, channel 514 includes a central groove 516 to accommodate dimples 440 of belt 422.

Figure 6:
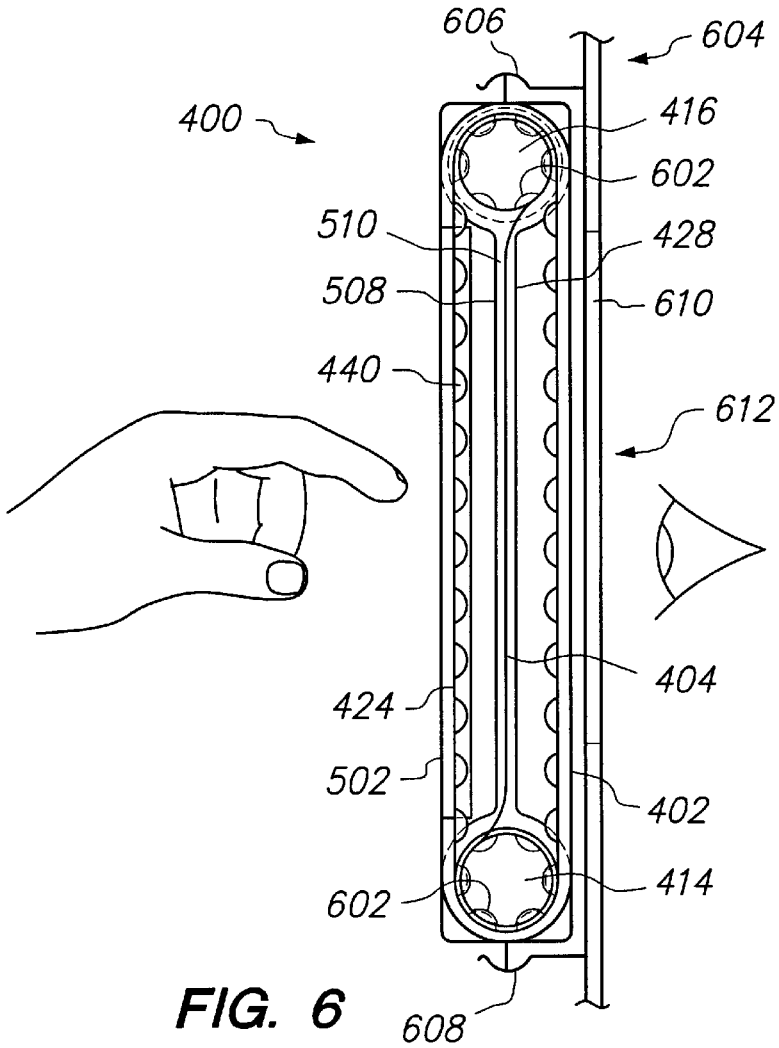
FIG. 6 is a cross sectional view, taken along line 6—6, of the magnetic display system of FIG. 4.

FIG. 6 is a cross-sectional view of display system 400, taken along line 6—6 of FIG. 4. This view shows wheels 414 and 416 to include a plurality of engaging structures 602 for engaging belt 424. In this particular embodiment, engaging structures 602 are depressions into which dimples 440 fit. However, those skilled in the art will understand that belts 422 and 424 and wheels 410, 412, 414, and 416 may employ alternate complementary engaging structures, including but not limited to rib/rib or aperture/post combinations. Further, if wheels 410, 412, 414, and 416 and belts 422 and 424 are formed with a sufficiently tacky material (e.g., soft rubber), then engaging structures may be omitted.

FIG. 6 further shows display system 400 mounted to a presentation structure 604. Presentation structure 604 includes a first retaining clip 606, a second retaining clip 608, and a front panel 610. Retaining clips 606 and 608 hold display system 400 in place with respect to front panel 610. Front panel 610 includes a window 612 through which scenery sheet 404 and any magnetic devices displayed on front screen 428 may be viewed. Because a user can easily snap display system 400 into and out of presentation structure 604, a variety of individual display systems can be used with a single presentation structure. For example, different versions of display system 400 can be manufactured as self-contained cassettes, each with a scenery sheet for presenting a different puppet show.

Those skilled in the art will recognize that presentation structure 604 is shown representationally in FIG. 6, and that presentation structure 604 may actually be embodied in a number of different structures, including but not limited to an easel, a simple frame, or a theatrical backdrop. For example, in a particular embodiment, presentation structure 604 is formed in a conventional brief case. The lid of the brief case forms front panel 610, and a window 612 is cut into the lid. This particular embodiment has the advantage that the brief case can carry a number of cassettes (display system 400), as well as display devices, followers and controllers.

Further, as explained above with reference to FIG. 4, various components of display system 400 can be embodied in one or more detachable sub-systems. Thus, for example, the drive components of system 400 could be included in a drive module that is permanently fixed to front panel 610, and spools 406 and 408, scenery sheet 404, a portion of front screen 428, and a portion of a rear screen 508 may be manufactured as a detachable cassette.

Figure 7:
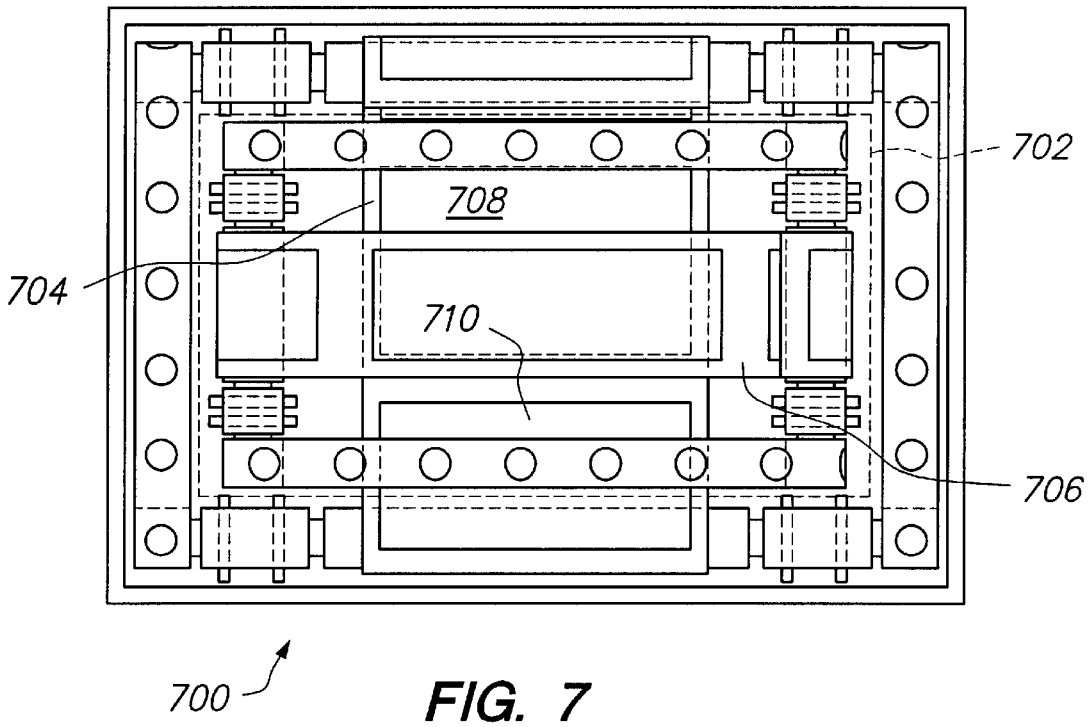
FIG. 7 is a rear plan view of another alternate magnetic display system according to the present invention.

FIG. 7 is a rear view of an alternate display system 700 according to the present invention. Display system 700 is presented to show that display systems according to the present invention may be implemented with more than one scenery sheet. Display system 700 is similar to display system 400, except that display system 700 includes an additional transverse scenery roller assembly 702. System 700 thus includes two continuous scenery sheets 704 and 706, with sheet 704 disposed in front of sheet 706. Scenery sheet 704 includes solid scenery panels 708 as well as transparent panels 710. When a user advances scenery sheet 704 to a position where a transparent panel 710 is positioned in the display area, a viewer is able to see scenery sheet 706 through transparent panel 710.

The cooperation of scenery sheets 704 and 706 facilitates the creation of visual effects not available with single scenery sheet systems. For example, a panel 708 in scenery sheet 704 can depict an interior room setting with a window, the window including an aperture or transparent portion in scenery sheet 708 through which scenery sheet 706 is visible. As scenery sheet 706 is advanced, objects (e.g., birds, people, etc.) depicted on scenery sheet 706 would appear to pass by the window of the room.

Figure 8:
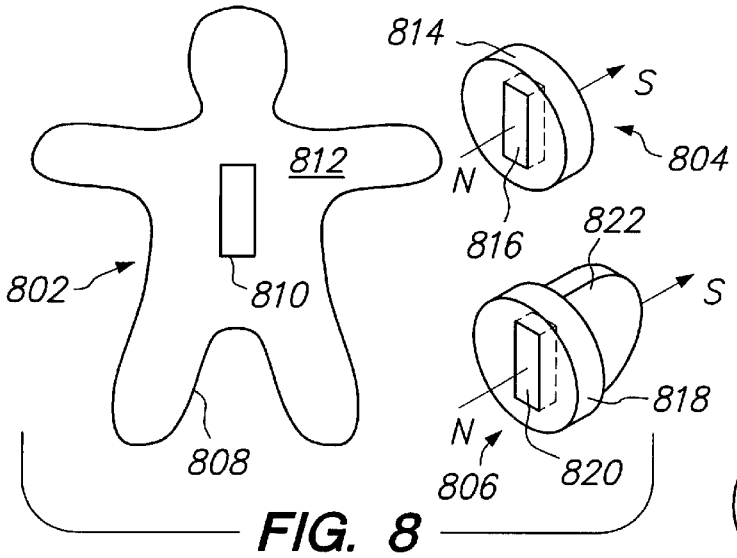
FIG. 8 shows a magnetic puppet, a magnetic follower, and a magnetic device controller for use with the magnetic display systems of the present invention.

FIG. 8 shows a display group including a magnetic display device 802 (e.g., a magnetic puppet), a magnetic follower 804, and a controller 806, for use with magnetic display systems of the present invention. Display device 802 includes a display piece 808 and a magnetic strip 810 (e.g., iron, sheet-magnet, etc.) fixed to a back surface 812 of display piece 808. The front surface (not shown) of display piece 808 is suitably decorated for its intended use (e.g., use as a puppet).

Follower 804 includes a body 814 and a magnet 816. Body 814 is constructed of a non-magnetic material. Magnet 816 attracts strip 810 of display device 802, when brought into close proximity, thus holding display device in contact with follower 804. Body 814 holds magnet 816 in place and prevents undesirable flipping of magnet 816. Additionally, body 814 is suitable dimensioned to prevent the magnets of adjacent followers on a screen from getting close enough to magnetically couple with magnet 816, thereby causing the attached display devices to stick together. As long as body 814 keeps the magnetic proximity between follower 804 and controller 806 (through the screens of the display system) closer than the magnetic proximity between adjacent followers, controller 806 will be able to exert a greater force on follower 804 than the forces exerted by adjacent followers.

Controller 806 includes a body 818, a magnet 820, and a handle 822. Body 818 and magnet 820 of controller 806 are similar in structure and function to body 814 and magnet 816 of follower 804. However, magnet 820 of controller 806 magnetically couples to magnet 816 of follower 804 through the front and back screens of a display system, and not directly with strip 810 of display device 802. Handle 822 provides a convenient means for a user to grasp controller 806 in order to move controller 806 and magnetically coupled follower 804 and display device 802 on a display system.

Although display device 802 could be displayed and moved on a display system directly by controller 806, the use of follower 804 provides better control over display device 802. Therefore, a mounted display device is generally a part of a display group which includes the display device, at least one follower, and at least one controller, all of which work together to effectively display the display device. In particular, magnets 816 and 820 each include a north pole (N) and a south pole (S). When controller 806 and follower 804 magnetically couple, the opposite poles of magnets 820 and 816 attract one another. The magnetic attraction between magnets 816 and 820 is sufficiently strong to overcome frictional forces which might cause spurious rotations of follower 804 or display device 802.

In this particular embodiment, magnets 816 and 820 are polarized transversely (i.e., perpendicular to the contact surfaces of follower 804 and controller 806, respectively), as shown in FIG. 8. In this case, rotational control of follower 804 by controller 806 results from the elongated shapes of magnets 816 and 820, because the forces between magnets 816 and 820 tend to maintain their alignment.

Alternatively, magnets 816 and 820 can be polarized longitudinally (i.e., parallel to the contacting surfaces of follower 804 and controller 806, respectively. Longitudinal polarization results in stronger attraction between follower 804 and controller 806, and stronger rotational control due to the strong attraction between the poles located at the ends of the magnets.

Figure 9:
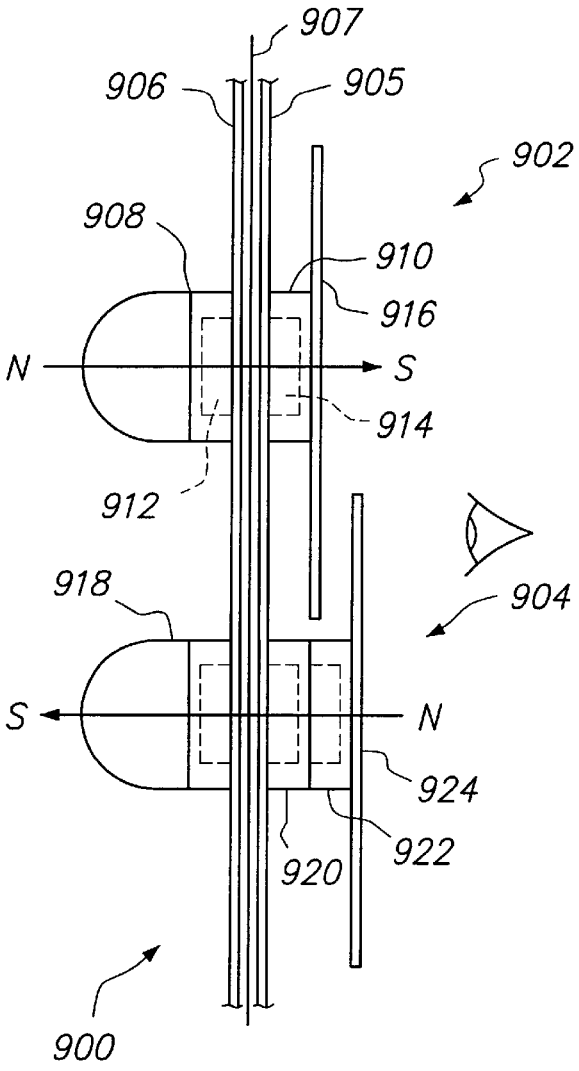
FIG. 9 is a side view of magnetic display devices, magnetic followers, and magnetic device controllers, magnetically coupled through a magnetic display system of the present invention.

FIG. 9 is a side view showing a portion of a display system 900 having two display groups 902 and 904 displayed thereon. Display system 900 includes a front screen 905, a rear screen 906, and a scenery sheet 907 disposed therebetween. A first controller 908 is magnetically coupled to a first follower 910, through front screen 905, rear screen 906, and scenery sheet 907, by magnets 912 and 914. A first display device 916 is held to first follower 910 by the attraction between magnet 914 and the magnetic strip (not shown) fixed to the back surface of display device 916.

The magnetic coupling between controller 908 and follower 910 is sufficient to maintain their position on display system 900, even when controller 908 is released by a user. Additionally, front screen 905 and rear screen 906 prevent frictional contact between scenery sheet 907 and follower 910 and controller 908, respectively. Thus scenery sheet 907 can be moved without disturbing the position of controller 908 and follower 910, even when controller 908 is not being held in place by a user. Front screen 905 and rear screen 906 are optionally textured to reduce the frictional drag between front screen 905 and display devices, and between rear screen 906 and controllers.

Second display group 904 includes controller 918, a first follower 920, a second follower 922 and a display device 924. Second controller 918 is identical to first controller 908, followers 920 and 922 are identical to follower 910, and display device 924 is identical to display device 916. However, because followers 920 and 922 are stacked, display device 924 is disposed farther from front screen 905 than display device 916. This disparity in position allows a portion of display device 916 to pass behind display device 924, providing a sense of depth to viewers of display system 900. Additional depth can be achieved by using a greater number of stacked followers. The number of followers used in a particular display group is limited only by weight and magnet strength considerations.

The magnets of controller 908, follower 910, controller 918, follower 920, and follower 922 are all polarized transversely, as shown in FIG. 9. Note that the direction of transverse polarization (e.g., left-to-right or right-to-left in FIG. 9) is not critical. For example, the magnets of display group 902 are polarized in one direction, and the magnets of display group 904 are polarized in the opposite direction. What is important is that all of the transversely polarized magnets in a particular display group are polarized in the same direction, with the north pole of one magnet facing the south pole of an adjacent magnet.

Alternatively, the magnets of display groups 902 and 904 can be polarized longitudinally. As explained above, longitudinal polarization of the magnets in a display group results in stronger attraction between the individual devices, and greater rotational control. Further, followers with longitudinally polarized magnets can be used in either orientation (i.e., flipped to face one way or the other).

Figure 10:
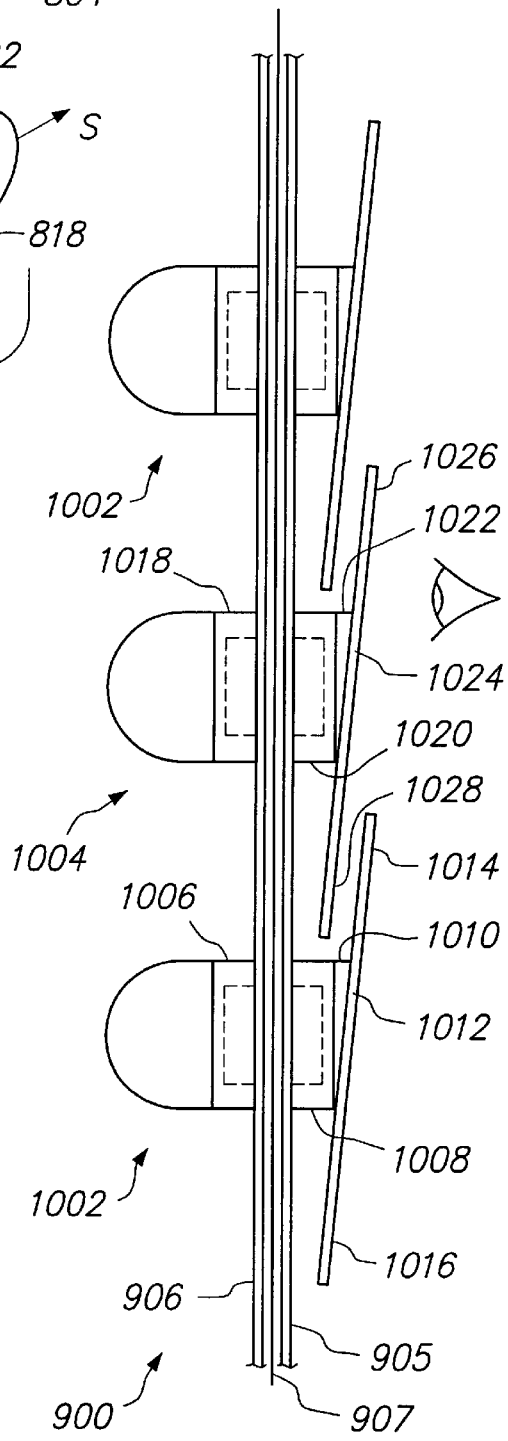
FIG. 10 is a side view showing alternate magnetic display devices on a magnetic display system of the present invention.

FIG. 10 shows a side view of two display groups 1002 and 1004 disposed on display system 900. Display group 1002 includes a controller 1006, a follower 1008, a wedge 1010, and a display device 1012. Controller 1006, follower 1008, and display device 1012 are substantially similar in structure and function to previously described controller 908, follower 910, and display device 916, respectively. Wedge 1010 is interposed between follower 1008 and display device 1012, and causes a first portion 1014 of display device 1012 to be disposed farther from front screen 905 than a second portion 1014 of display device 1012. Display group 1004 is identical to display group 1002, and includes a controller 1018, a follower 1020, a wedge 1022, and a display device 1024. Display device 1024 includes a first portion 1026 and a second portion 1028, with first portion 1026 being disposed farther from front screen 905 than second portion 1028.

Wedge 1010 may be formed as a separate component, or may be embodied in one of follower 1008 or display device 1012. For example, wedge 1010 may simply be a thin wedge of magnetic material that is attracted to follower 1008 the same as display device 1012. Alternatively, wedge 1010 may be formed integrally with follower 1008, such that the surface of follower 1008 that contacts front screen 905 is non-parallel to the surface of follower 1008 that contacts display device 1012. As yet another example, wedge 1010 may be permanently adhered to display device 1012, and one surface of follower 1008 may be adapted to include an identical wedge. Thus, in one position the complementary wedges would offset one another such that display device 1012 is presented parallel to front screen 905. However, if the adapted follower were rotated 180 degrees with respect to display device 1012, the complementary wedges would augment one another, tilting display device 1012 with respect to front screen 905.

Figure 11:
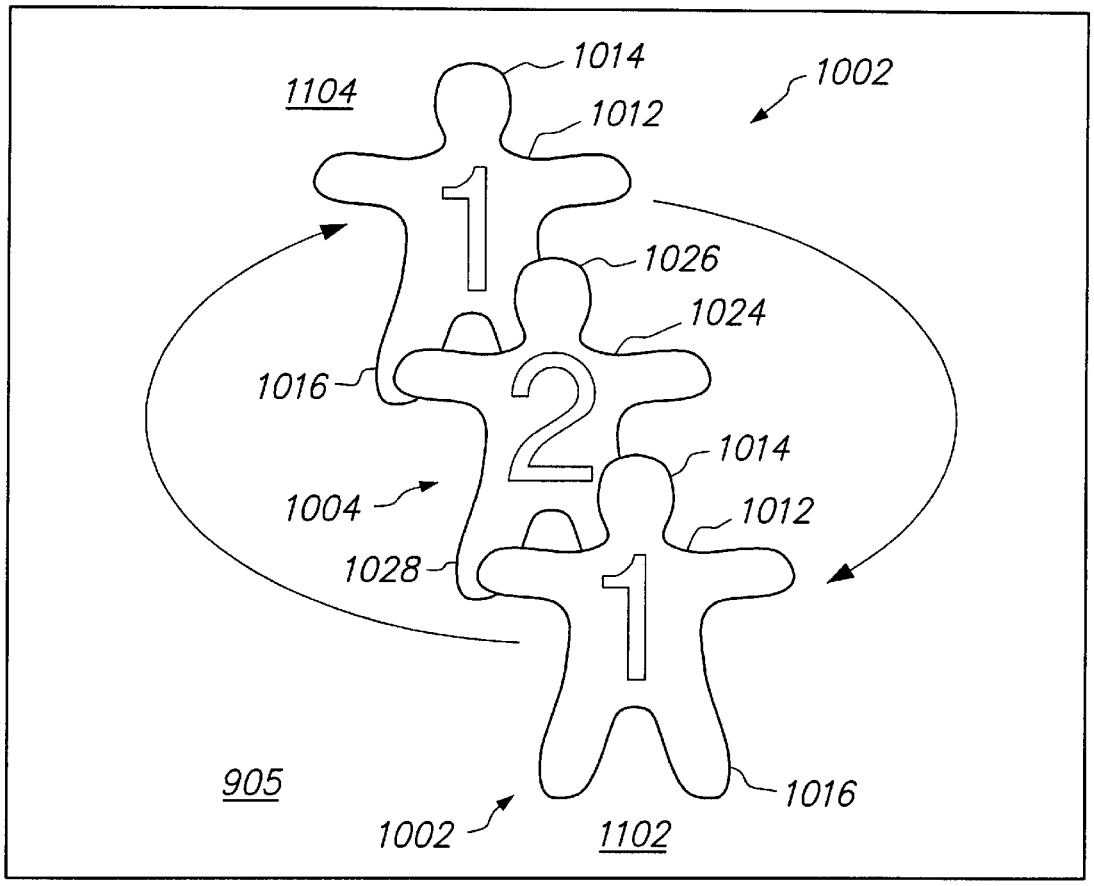
FIG. 11 is a front view of the magnetic display devices and display system shown in FIG. 10.

FIG. 11 is a front view of display system 900 with display groups 1002 and 1004 disposed thereon, illustrating on visual effect that can be achieved with display groups 1002 and 1004. Display group 1002 is shown twice in FIG. 11 to illustrate movement about display group 1004. In a first position 1102, portion 1014 of display device 1012 is disposed in front of portion 1028 of display device 1024, making display device 1012 appear to be in front of display device 1024. When display device 1012 is moved around display device 1024 to a second position 1104, portion 1016 of display device 1012 is disposed behind portion 1026 of display device 1024, making display device 1012 appear to be behind display device 1024. Thus, as display device 1012 is rotated about display device 1024, display device 1012 appears to move around display device 1024 in a path that is not confined to the two dimensions of front screen 905.

It is not necessary to use two wedged display groups to generate the above-described effect. For example, the same effect can be achieved by moving a wedged display group (e.g., display group 1002) about some other types of display groups (e.g., display group 902 or other display groups described hereinafter).

Figure 12:
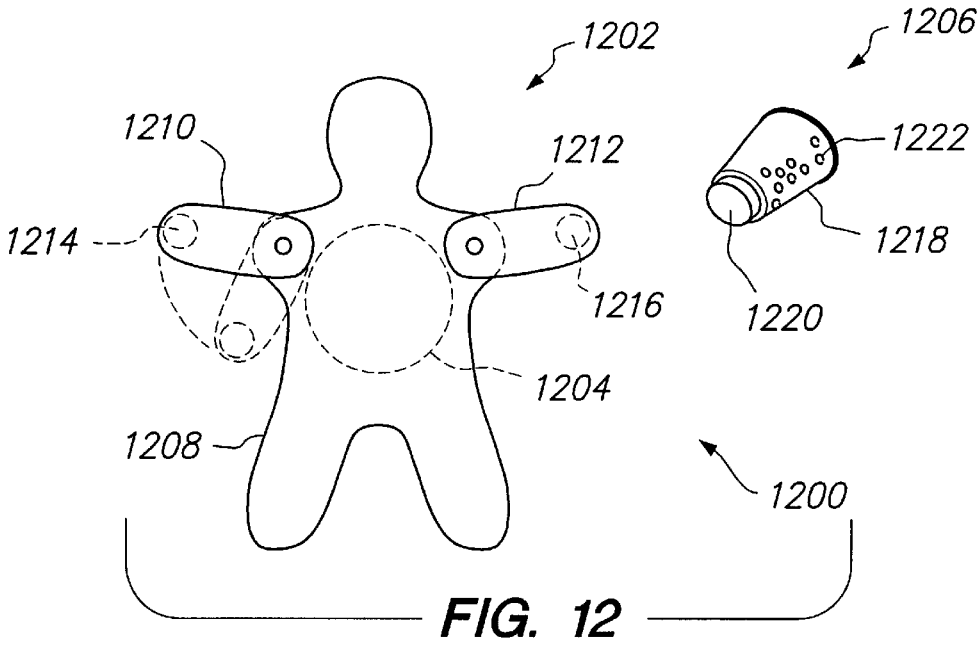
FIG. 12 shows a jointed magnetic display device and controller for use with a magnetic display system of the present invention.

FIG. 12 shows a jointed display group 1200 including a jointed display device 1202, a follower 1204, and a fingertip controller 1206. Display group 1200 further includes a controller (not shown in FIG. 12) similar to controller 806. Display device 1202 includes a main display piece 1208, and two appendages 1210 and 1212 pivotally attached to display piece 1208. Appendages 1210 and 1212 include button magnets 1214 and 1216, respectively, fixed to the back surfaces of their distal tips. Fingertip controller 1206 includes a truncated cone 1218 with a button magnet 1220 fixed to the truncated end. A plurality of indentations 1222 in cone 1218 provide a gripping surface on the interior of cone 1218, to help keep cone 1218 on a users finger, like a conventional thimble. Controller 1206 can be conveniently worn on the same hand that is used to manipulate the controller (not shown) of display group 1200.

Figure 13:
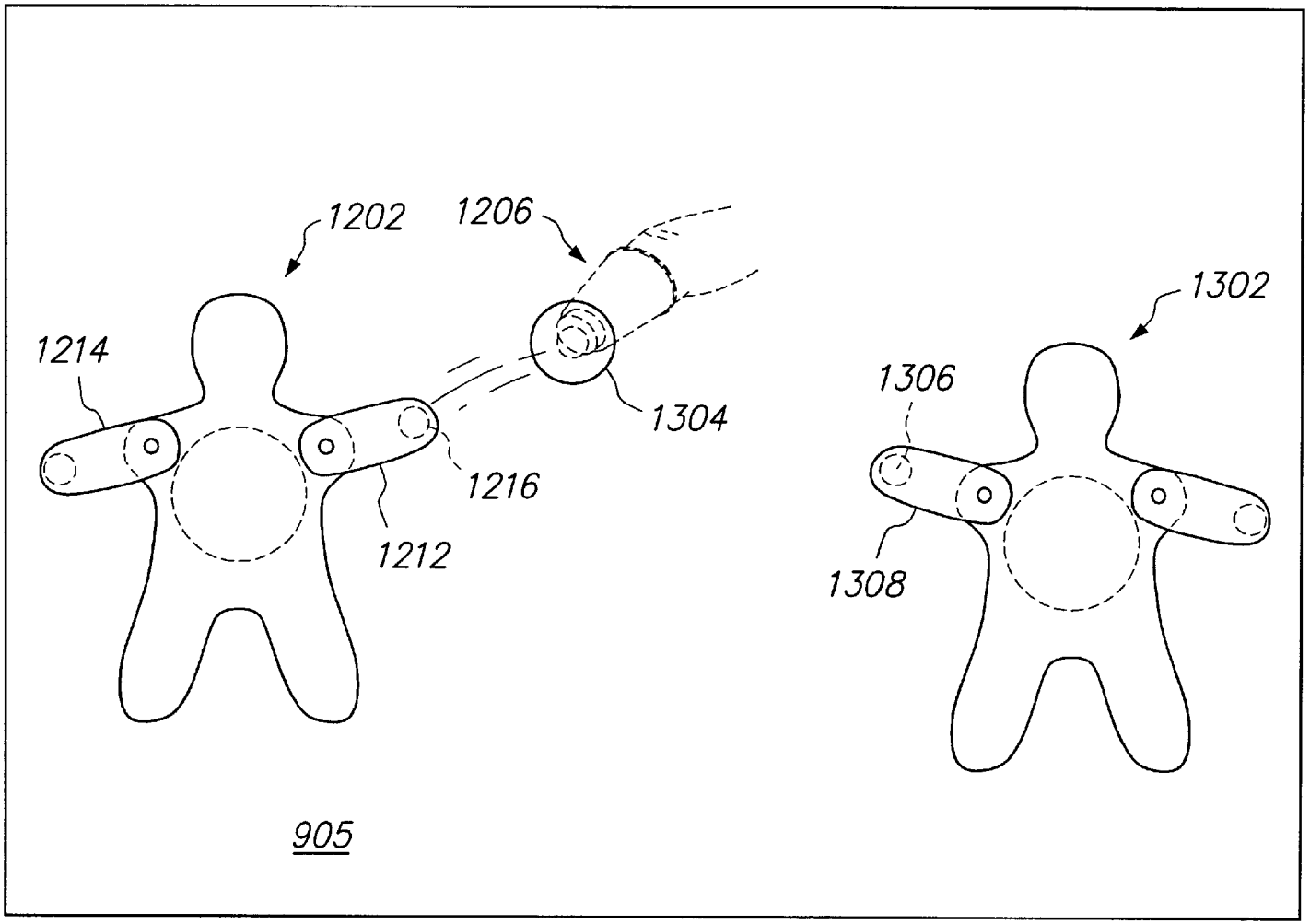
FIG. 13 is a front view showing the operation of two jointed magnetic display devices on a magnetic display system according to the present invention.

FIG. 13 shows display 900 with display device 1202, a display device 1302, and a display device 1304 displayed on front screen 905. Display device 1302 is identical to display device 1202, and in this particular example are characters playing catch. Display device 1304 is a ball. Initially, ball 1304 is coupled to magnet 1216. Then, a user engages ball 1304 with controller 1206 (from the back side of display system 900), and draws ball 1304 across screen 905, toward character 1302. When ball 1304 gets close enough to a button magnet 1306 in the distal end of appendage 1308 of character 1302, ball 1304 couples with magnet 1306, and the toss and catch is complete.

Appendages (e.g., 1212 and 1214) can be to retain their position when not engaged by controller 1206 in a number of ways. For example, the joints between the appendages and the main display pieces can be made tight fitting so that the appendages only move when engaged by a controller. As another example, rear screen 906 or scenery sheet 907 (not shown in FIG. 12) can include a magnetic material (e.g., fine steel screen, sheet-magnet, etc.) so that the button magnets (e.g., 1214 and 1216) at the distal ends of the appendages will stick to the display system 900, holding them in place.

Figure 14:
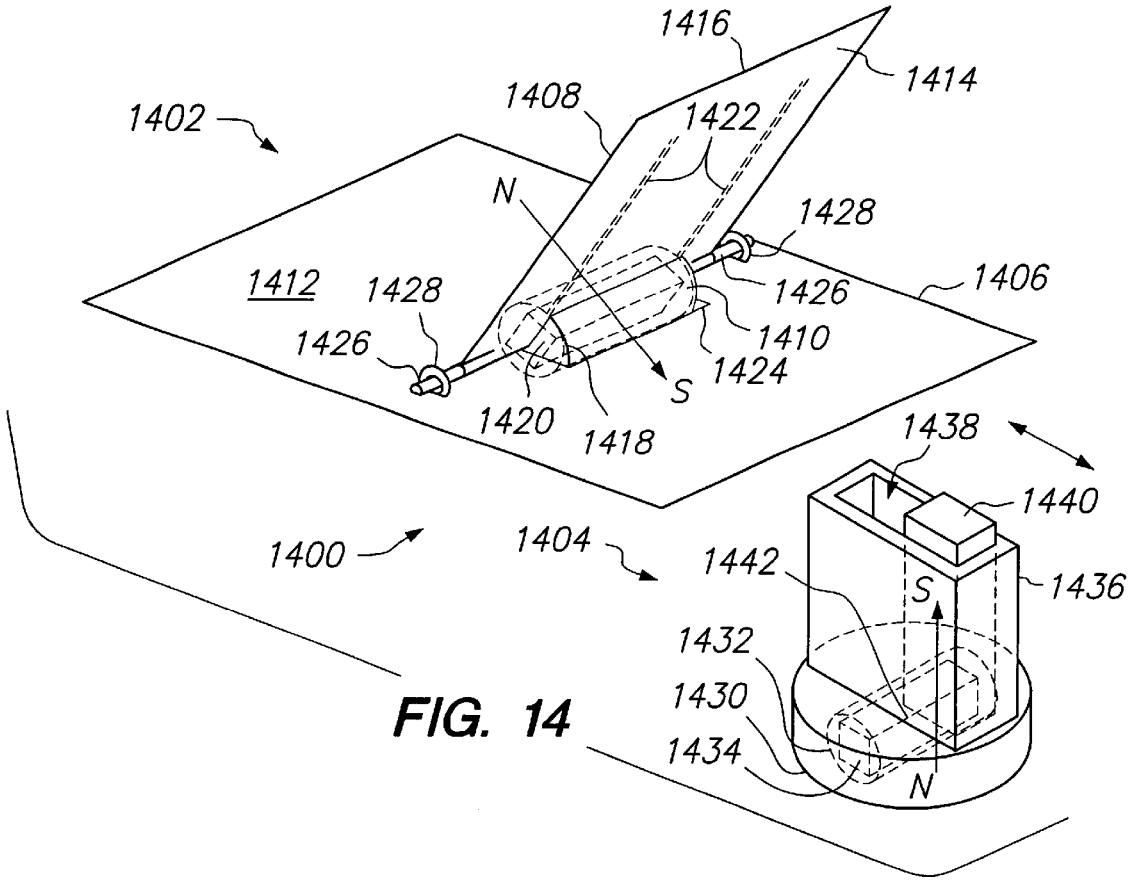
FIG. 14 shows a flipping display device and controller for use with a magnetic display system of the present invention.

FIG. 14 shows a flip-device display group 1400, including a flipping display device 1402 and a controller 1404. Flipping display device 1402 includes a background piece 1406, a flipping piece 1408, and a flipping mechanism 1410. Background piece 1406 has a front surface 1412 which always faces the viewer. Flipping piece 1408 has two surfaces 1414 and 1416, one of which faces the viewer when flipping piece 1408 is in a first position, and the other of which faces the viewer when piece 1408 is flipped into a second position. Flipping mechanism 1410 includes a cylindrical body 1418, a magnet 1420 housed in cylindrical body 1418, and one or more attachment structures 1422 for fastening flipping piece 1408 to cylindrical body 1418. Cylindrical body 1418 is held in an aperture 1424 defined in background piece 1406 by pivot pins 1426 which extend coaxially from the ends of body 1418 and engage a pair of attachment loops 1428 fixed to background piece 1406.

Controller 1404 includes a base 1430, a cylindrical magnet housing 1432, a magnet 1434, a rectangular handle 1436 extending from base 1430, a rectangular cavity 1438 formed in handle 1436, and a slide bar 1440 disposed in cavity 1438. Cylindrical magnet housing 1432 is loosely mounted in body 1430 so as to be freely rotatable in body 1430. As a user moves slide bar 1440 from one side of cavity 1438 to the other, a bottom surface 1442 of slide bar 1440 engages cylindrical housing 1432, causing it to rotate about its axis within base 1430. The length of cavity 1438 and the diameter of cylindrical housing 1432 are selected to achieve the desired amount of rotation (e.g., 180 degrees) from one full slide of slider 1440. Any number of suitable engaging means (e.g., teeth, rough surfaces, tacky surfaces, etc.) may be used to facilitate the engagement of cylindrical housing 1432 by bottom surface 1442 of slider 1440.

Background piece 1406 is optional. For example, in some embodiments it is desirable for the entire display device to flip. In such cases, background piece 1406 is omitted, and flipping portion 1408 and flipping mechanism 1410 operate as a complete display device. Additionally, a user can directly manipulate (e.g., with his fingers) cylindrical housing 1432 and magnet 1434, without the rest of controller 1404, to control flipping mechanism 1410.

In this particular embodiment magnets 1420 and 1434 are polarized transversely (i.e., perpendicular to the axes of cylindrical body 1418 and cylindrical housing 1432, respectively), facilitating the rotation of one of the magnets by rotating the other. A simple alternative flip-puppet can be constructed, however, by substituting a longitudinally polarized magnet for magnet 1420. The alternate flip-puppet is controlled with a controller similar to controller 806 of FIG. 8, but with a longitudinally polarized magnet. The controller engages the puppet through a display screen, but does not itself provide a magnetic force to flip the puppet. Rather, when the flip-puppet is moved in one direction by the controller, it flips one way due to the frictional force between the cylindrical housing and the display screen. When the direction of movement is reversed, the flip-puppet flips in the opposite direction, again due to the frictional force between the cylindrical housing and the display screen.

Figure 15:
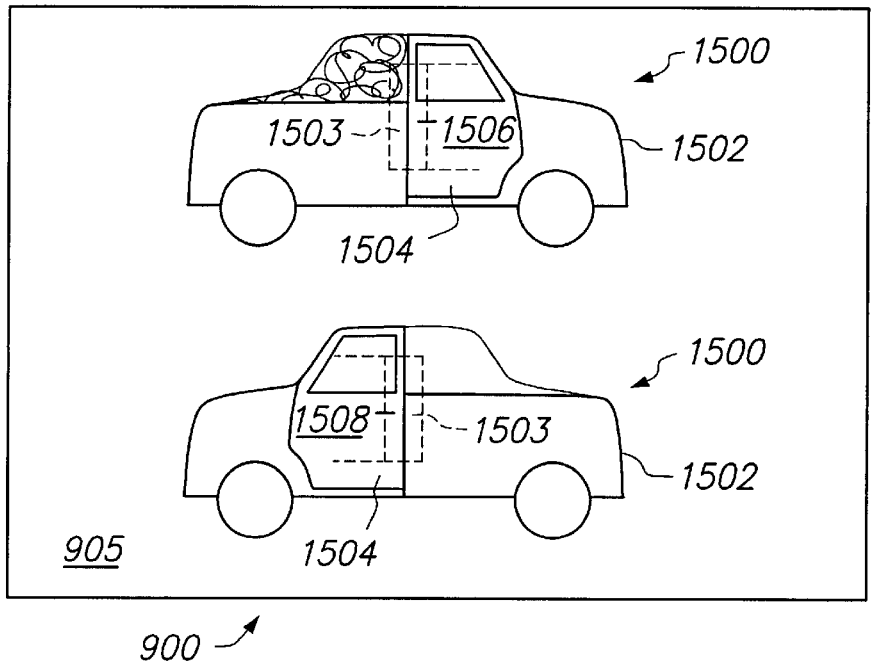
FIG. 15 shows a flipping display device on a magnetic display system of the present invention in two different positions.

FIG. 15 shows display system 900 with a flipping display device 1500 (shown twice) in two different positions. Flipping device 1502 includes a background piece 1502, a flipping mechanism 1503, and a flipping piece 1504. Magnet 1434 of controller 1404 (not visible in FIG. 15) engages the magnet (not shown) of flipping mechanism 1503 from behind display system 900, and thereby holds display device 1502 on front screen 905 of display system 900. The polarities of magnet 1434 and the magnet of flipping device 1503 align to hold flipping piece 1504 in a first position with a first side 1506 facing the viewer. Rotating magnet 1434 with slider 1440 redirects the magnetic poles of magnet 1434, causing the magnet of flipping device 1503 to rotate in order to maintain the alignment between the poles of the two magnets. As the magnet of flipping device 1503 rotates, flipping piece 1504 is flipped so that a second surface 1508 becomes visible to a viewer.

Figure 16:
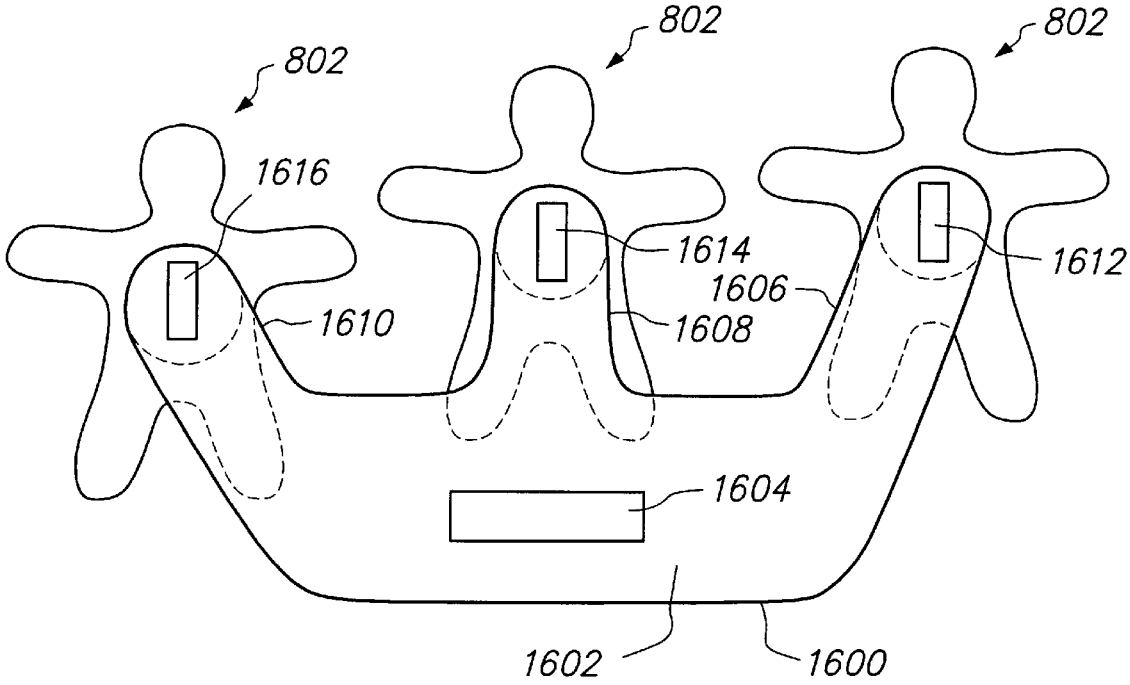
FIG. 16 shows a plurality of magnetic display devices and a magnetic gang controller for use with a magnetic display system of the present invention.

FIG. 16 shows a gang controller 1600 for simultaneously controlling a plurality of display devices 802(1–3)each of which is substantially similar to display device 802 (FIG. 8). Gang controller 1600 includes a main body 1602, a handle 1604 extending (out of the page) from main body 1602, a plurality of extension arms 1606, 1608, and 1610, and a plurality of magnets 1612, 1614, and 1616, each disposed near a distal end of a respective one of extension arms 1606, 1608, and 1610. Each arm of gang controller 1600 functions similarly to controller 806 (FIG. 8), but because the positions of magnets 1612, 1614, and 1616 are fixed relative to one another, the same spatial relationship is easily maintained between the controlled display devices 802(1–3). Gang controller 1600 may optionally include any number of extension arms, which can be arranged in any desirable pattern.

Figure 17A:
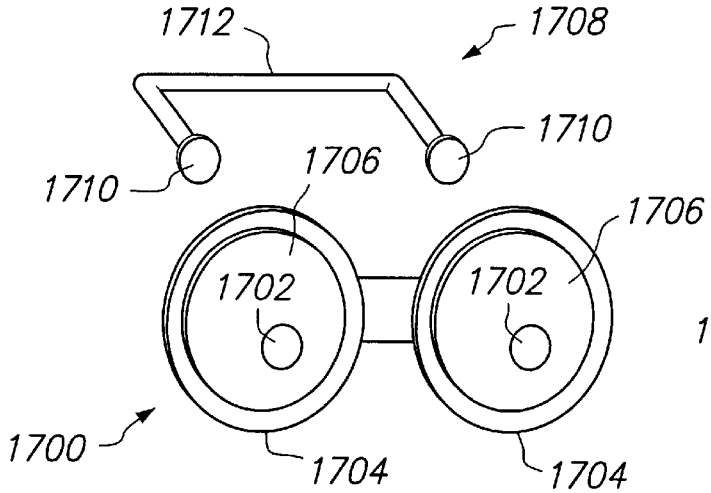
FIG. 17A is a perspective view of an alternate magnetic display device and controller for use with a magnetic display system of the present invention.

FIG. 17A shows another type of display device 1700, which can be used with a display system of the present invention. In this particular embodiment, display device 1700 appears as a pair of eyes. Each eye includes a freely moveable button magnet 1702 encapsulated in a container 1704 with a clear cover 1706. Button magnets 1702 can be moved simultaneously with a small gang controller 1708, to simulate the way eyes actually move together. Gang controller 1708 includes a pair of magnetic ends 1710 joined by a connecting member 1712. Connecting member 1710 can also be used as a handle to manipulate controller 1708. As with other disclosed display devices, display device 1700 may be used alone or in conjunction with some other type of display device.

Figure 17B:
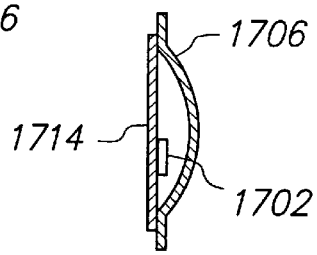
FIG. 17B is a cross-sectional view of the magnetic puppet of FIG. 17A.

FIG. 17B shows a cross-sectional view of one of eyes 1704. In this particular embodiment, clear cover 1706 is a plastic bubble that is adhered to a backing 1714. In a more particular embodiment, backing 1714 includes a magnetic material (e.g., steel screen, sheet magnetic material, etc.), such that button magnets 1702 retain their position on backing 1714, even when controller 1708 is removed.

Figure 18:
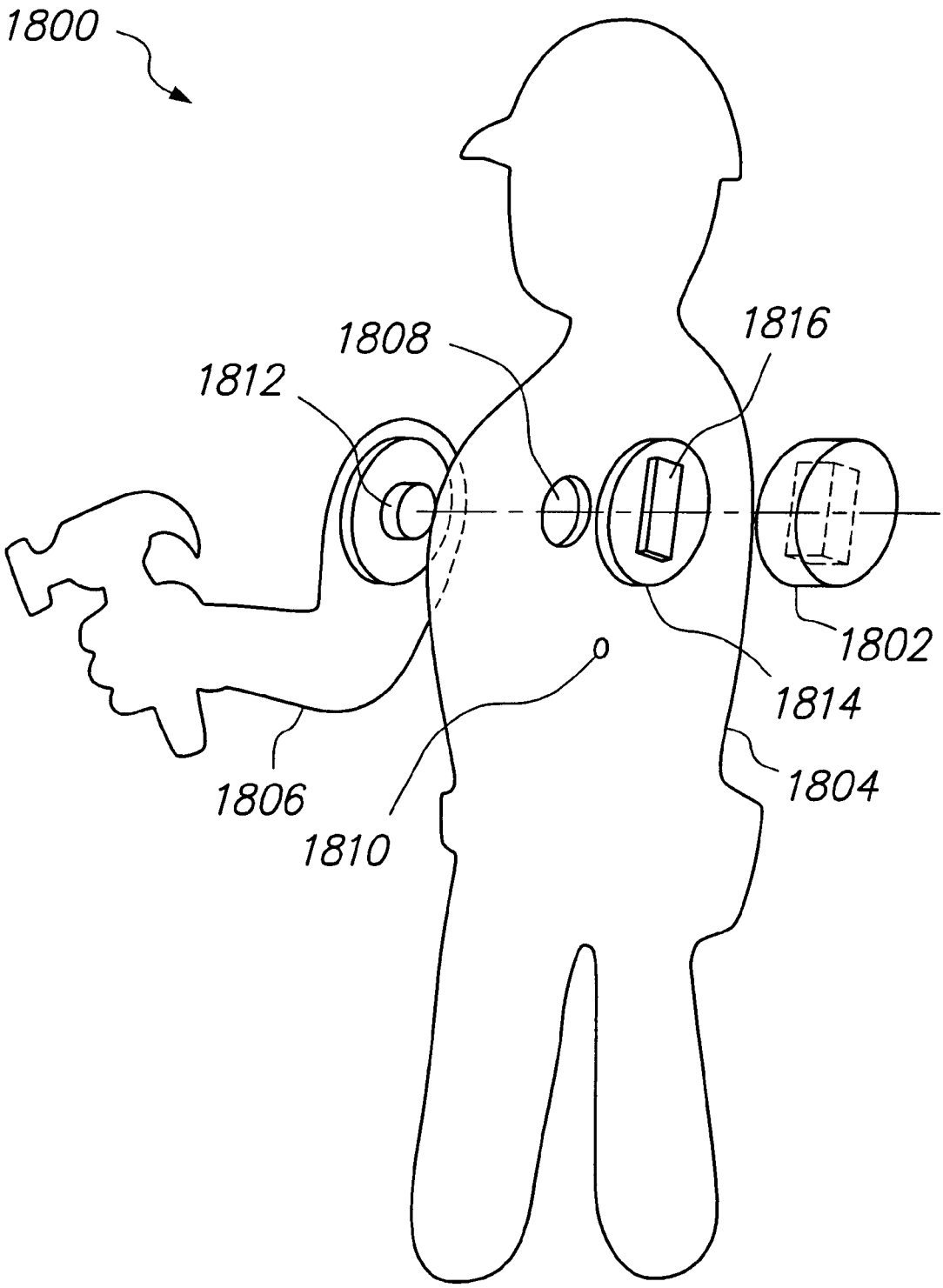
FIG. 18 is an exploded view of a hanging magnetic display device.

FIG. 18 is an exploded view of a hanging display device 1800 and a follower 1802, for use with a display system of the present invention. Display device 1800 includes a hanging portion 1804 and a pivoting portion 1806. Hanging portion 1804 includes an aperture 1808, which is disposed above the center of gravity 1810 of hanging portion 1804. Pivoting portion 1806 includes a cylindrical shaft 1812 which extends through aperture 1808, and upon which display portion 1804 is suspended. A cap 1814 is fastened to the end of shaft 1812, to retain shaft 1812 in aperture 1808. A magnetic strip 1816 is fixed to cap 1814 to facilitate engagement by follower 1802, as described above with respect to other disclosed display devices.

Display device 1800 is manipulated with a controller substantially similar to controller 806 described above with reference to FIG. 8. Thus, display device 1800 can be moved about on a display system of the present invention by so moving magnetically coupled controller 806. Display device 1800 can be further manipulated by rotating controller 806. When controller 806 is rotated, magnetically coupled follower 1802, cap 1814, and pivoting portion 1806 also rotate about an axis roughly coaxial with respect to cylindrical shaft 1812. Hanging portion 1804 freely pivots about cylindrical shaft 1812, and, therefore, retains its position under the force of gravity.

Figure 19A:
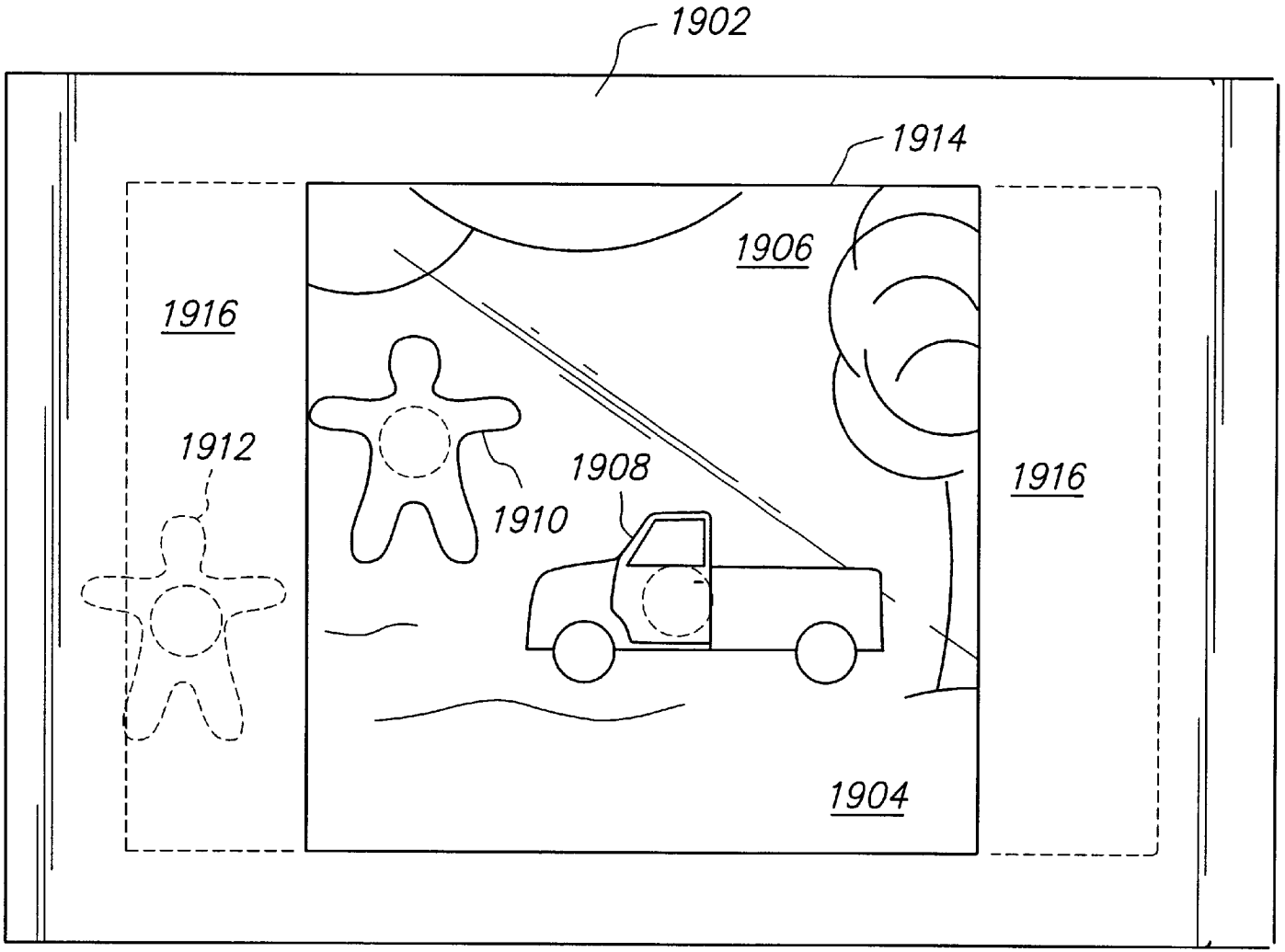
FIG. 19A is a front view of a magnetic display system of the present invention.

FIG. 19A is a front view of an alternate display system 1900 according to the present invention. Display system 1900 includes a front panel 1902, a front display screen 1904, a scenery sheet 1906 visible through front screen 1904, and a rear screen (not visible). A number of display devices 1908, 1910, and 1912 are held on front screen 1904 by controllers (not shown in FIG. 19A). Front panel 1902 includes a window 1914 through which a portion of front screen 1904 is visible. The remaining portion 1916 of front display screen 1904 is hidden from viewers by panel 1902, and provides a convenient location for storing display devices not currently being displayed (e.g., puppets waiting in the wings).

Figure 19B:
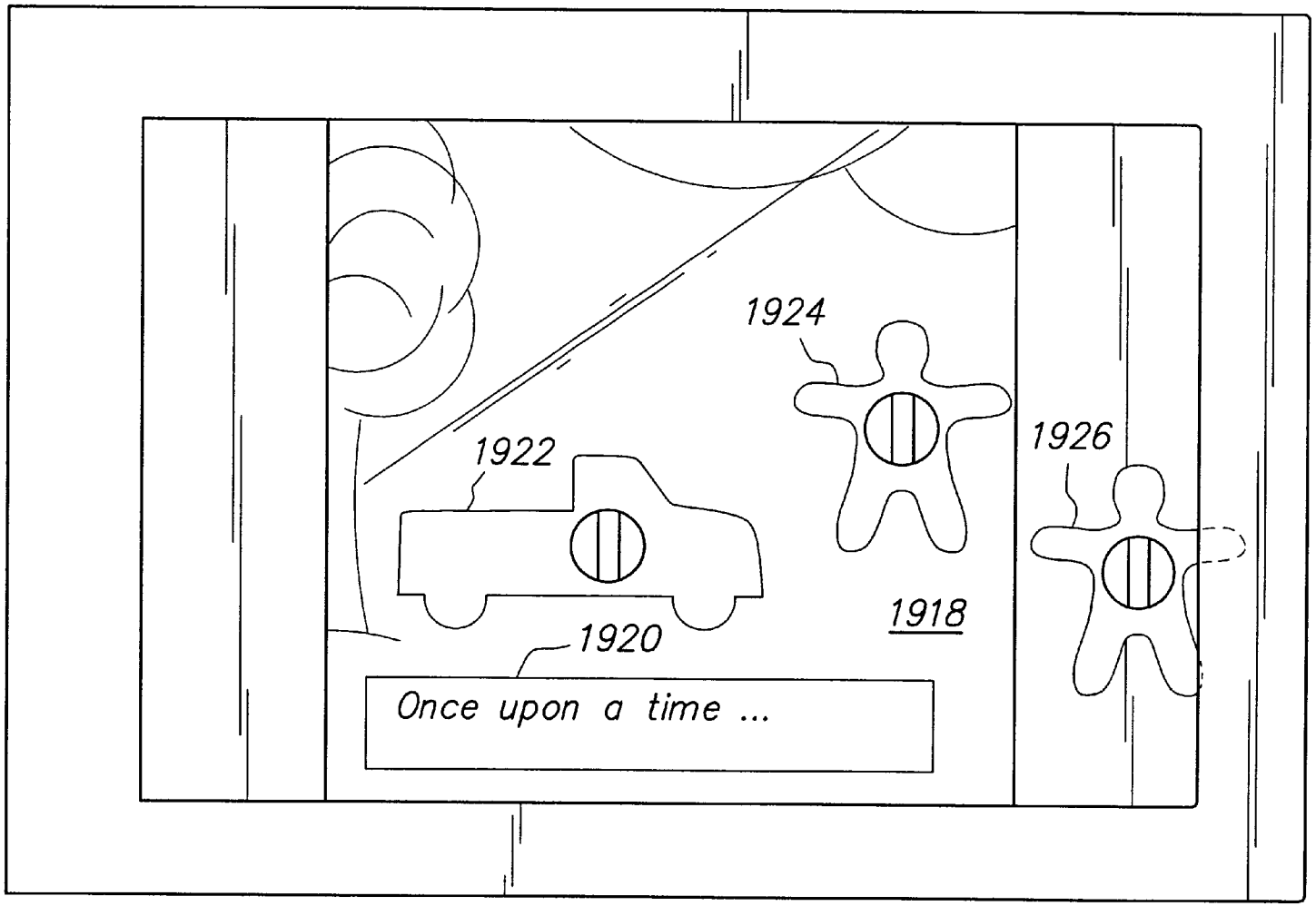
FIG. 19B is a rear view of the magnetic display system of FIG. 19A.

FIG. 19B is a rear view of display system 1900, and illustrates unique features of this particular embodiment that makes display system 1900 easy to use, and therefore particularly well suited for use by children. In particular, the scene depicted on scenery sheet 1906 is visible through the back side of scenery sheet 1906 and a rear display screen 1918. Furthermore, the back of scenery sheet 1906 includes text 1920, for example the narrative of a puppet show being presented on display system 1900. FIG. 19B also shows the controllers 1922, 1924, and 1926 which are being used to control display devices 1908, 1910, and 1912, respectively. Note that controllers 1922, 1924, and 1926 are each adapted to resemble the display device that they are controlling, thus making it easy for a user of system 1900 to keep track of the display devices displayed thereon.

The description of particular embodiments of the present invention is now complete. Many of the described features may be substituted, altered or omitted without departing from the scope of the invention. For example, many of the disclosed display devices are novel in their own right, and can be used with display systems other than those described herein. As another example, the display devices of the present invention may be fastened to the followers of the present invention by some means (e.g., hook-loop fasteners, permanently adhered, etc.) other than a magnetic strip. As another example, followers of varying thicknesses including one or more magnets may be substituted for a plurality of stacked followers. These and other deviations from the particular embodiments shown will be apparent to those skilled in the art, particularly in view of the foregoing disclosure.

What is claimed is:

1. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen; and at least one scenery sheet, for disposition within said scenery receiving space; and wherein said at least one scenery sheet comprises at least one card for insertion into and withdrawal from said scenery receiving space.

2. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen; and at least one scenery sheet, for disposition within said scenery receiving space; and wherein said at least one scenery sheet is disposed in a detachable cassette.

3. A display system according to claim 2, wherein at least one of said first screen and said second screen is embodied in said detachable cassette.

4. A display system according to claim 2, wherein at least a portion of said first screen is detachable from said cassette to provide access to said scenery sheet.

5. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen; and at least one scenery sheet, for disposition within said scenery receiving space; and wherein said at least one scenery sheet includes a transparent or translucent portion.

6. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen;

at least one scenery sheet, for disposition within said scenery receiving space;

a first spool fixed to a first end of said at least one scenery sheet, said first spool being rotatably mounted adjacent a first edge of said scenery receiving space for drawing said scenery sheet through said scenery receiving space in a first direction as said scenery sheet wraps around said first spool in a clockwise direction; and a second spool fixed to a second end of said scenery sheet, said second spool being rotatably mounted adjacent a second edge of said scenery receiving space for drawing said scenery sheet through said scenery receiving space in a second direction as said scenery sheet wraps around said second spool in a counter-clockwise direction;

a drive wheel rigidly fixed to a first end of said first spool;

a freely rotatable wheel mounted to a second end of said first spool;

a freely rotatable wheel mounted to a first end of said second spool;

a drive wheel rigidly fixed to a second end of said second spool;

a first drive belt engaging said drive wheel of said first spool and said freely rotatable wheel of said second spool; and a second drive belt engaging said freely rotatable wheel of said first spool and said drive wheel of said second spool.

7. A display system according to claim 6, wherein each of said drive belts includes engaging structures to facilitate belt advancement by a user.

8. A display system according to claim 7, wherein said engaging structures comprise dimples formed in said belts.

9. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen;

at least one scenery sheet, for disposition within said scenery receiving space;

a first spool fixed to a first end of said at least one scenery sheet, said first spool being rotatably mounted adjacent a first edge of said scenery receiving space for drawing said scenery sheet through said scenery receiving space in a first direction as said scenery sheet wraps around said first spool in a clockwise direction; and a second spool fixed to a second end of said scenery sheet, said second spool being rotatably mounted adjacent a second edge of said scenery receiving space for drawing said scenery sheet through said scenery receiving space in a second direction as said scenery sheet wraps around said second spool in a counter-clockwise direction;

a first wheel selectively engagable with a first end of said first spool;

a second wheel selectively engagable with a first end of said second spool; and a drive belt engaging said first wheel and said second wheel.

10. A display system for magnetic devices comprising:

a first screen formed integral with a first housing portion, said first screen having a front surface for contacting a magnetic device and a rear surface;

a second screen formed integral with a second housing portion, said second screen having a rear surface for contacting a magnetic device controller, and a front surface, said second screen fixed with respect to said first screen so as to define a scenery receiving space between said rear surface of said first screen and said front surface of said second screen;

at least one scenery sheet, for disposition within said scenery receiving space;

a first spool fixed to a first end of said at least one scenery sheet, for drawing said scenery sheet through said scenery receiving space in a first direction, said first spool being supported in a cavity defined between said first housing portion and said second housing portion; and a second spool fixed to a second end of said scenery sheet, for drawing said scenery sheet through said scenery receiving space in a second direction, said second spool being supported in a cavity defined between said first housing portion and said second housing portion; and wherein said first housing portion and said second housing portion are formed from a single sheet of material.

11. A display system according to claim 10, wherein said first housing portion and said second housing portion are vacuum formed from a single sheet of plastic.

12. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen;

at least one scenery sheet, for disposition within said scenery receiving space;

a first spool fixed to a first end of said at least one scenery sheet, for drawing said scenery sheet through said scenery receiving space in a first direction; and a second spool fixed to a second end of said scenery sheet, for drawing said scenery sheet through said scenery receiving space in a second direction; and wherein said at least one scenery sheet, said first spool, and said second spool are disposed in a detachable cassette.

13. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen; and at least one scenery sheet, for disposition within said scenery receiving space, said scenery sheet including a front surface including images for presentation with said magnetic devices, and a rear surface including information relating to the presentation of said magnetic devices.

14. A display system according to claim 13, wherein said information relating to the presentation of said magnetic devices includes story text.

15. A display system according to claim 13, wherein said information relating to the presentation of said magnetic devices includes at least a portion of said image included on said front surface of said scenery sheet.

16. A display system for magnetic devices comprising:

a first screen having a front surface for contacting a magnetic device and a rear surface; and a second screen having a rear surface for contacting a magnetic device controller, and a front surface, said second screen fixed with respect to said first screen so as to define a scenery receiving space between said rear surface of said first screen and said front surface of said second screen; and wherein said front surface of said first screen is textured.

17. A display system for magnetic devices comprising:

a first screen having a front surface for contacting a magnetic device and a rear surface; and a second screen having a rear surface for contacting a magnetic device controller, and a front surface, said second screen fixed with respect to said first screen so as to define a scenery receiving space between said rear surface of said first screen and said front surface of said second screen; and wherein said first screen is formed integral with a first peripheral portion, said first peripheral portion including at least one fastener;

said second screen is formed integral with a second peripheral portion, said second peripheral portion including at least one complementary fastener;

said second screen is fixed with respect to said first screen by engaging said fastener with said complementary fastener; and said fastener and said complementary fastener are vacuum formed dimples.

18. A display system according to claim 17, wherein said fastener is disposed adjacent said scenery receiving space to further function as an alignment guide to facilitate proper insertion of scenery media into said scenery receiving space.

19. A display system according to claim 17, farther comprising integral alignment guides formed in at least one of said first peripheral portion and said second peripheral portion to facilitate proper insertion of scenery media into said scenery receiving space.

20. A display system according to claim 19, wherein said first screen, said first peripheral portion, said second screen, and said second peripheral portion are all formed from a single sheet of material.

21. A display system according to claim 20, wherein said first screen, said first peripheral portion, said second screen, and said second peripheral portion are all vacuum formed from a single sheet of plastic.

22. A display system according to claim 17, further comprising a window sheet, fixed with respect to said first screen, through which said first screen is visible.

23. A display system according to claim 22, wherein said first screen, said first peripheral portion, said second screen, said second peripheral portion, and said window sheet are all formed from a single sheet of material.

24. A display system according to claim 23, wherein:

said window sheet is disposed between said first screen and said second screen in said single sheet of material; and said window sheet is disposed in front of said first screen when said single sheet of material is folded and said second screen is fixed with respect to said first screen by engaging said fastener with said complementary fastener.

25. A display system form magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said from surface of said second screen;

said magnetic device; and said magnetic device controller for magnetically engaging said magnetic device through said first screen and said second screen.

26. A display system according to claim 25, further comprising a magnetic follower, said magnetic follower including:

a body;

a first surface;

a second surface; and a magnet disposed within said body, for magnetically engaging said magnetic device through said first surface and for magnetically engaging said magnetic device controller through said second surface, said first screen, and said second screen.

27. A display system according to claim 26, wherein:

said body includes a non-magnetic material; and said body is adapted to maintain at least a predetermined space between said magnet and a second magnet of an adjacent follower.

28. A display system according to claim 25, wherein said magnetic device is a puppet.

29. A display system for magnetic devices comprising:

a first screen having a front surface for contacting a magnetic device and a rear surface;

a second screen having a rear surface for contacting a magnetic device controller, and a front surface, said second screen fixed with respect to said first screen so as to define a scenery receiving space between said rear surface of said first screen and said front surface of said second screen; and at least one scenery sheet, for disposition within said scenery receiving space; and wherein said scenery sheet includes a magnetic material.

30. A display system for magnetic devices comprising:

a first screen having a front surface for contacting a magnetic device and a rear surface; and a second screen having a rear surface for contacting a magnetic device controller, and a front surface, said second screen fixed with respect to said first screen so as to define a scenery receiving space between said rear surface of said first screen and said front surface of said second screen; and wherein one of said first screen and said second screen include a magnetic material.

* * * * *

UNITED STATES PATENT AND TRADEMARK OFFICE

CERTIFICATE OF CORRECTION

PATENT NO. : 6,383,051 B1 
DATED : May 7, 2002
INVENTOR(S) : Crossman et al.

It is certified that error appears in the above-identified patent and that said Letters Patent is hereby corrected as shown below:

Column 17,
Line 55, replace "claim 17, farther" with -- claim 17, further --;

Column 18,
Line 17, replace "A display system form magnetic devices" with -- A display system for magnetic devices --; and
Line 24, replace "and said from surface" with -- and said front surface --.

Signed and Sealed this

Twenty-sixth Day of November, 2002

*Attest:*

*Attesting Officer*

JAMES E. ROGAN
*Director of the United States Patent and Trademark Office*